US006476557B1

(12) United States Patent
Leng et al.

(10) Patent No.: US 6,476,557 B1
(45) Date of Patent: Nov. 5, 2002

(54) NON-ROTATING ELECTRODELESS LAMP CONTAINING MOLECULAR FILL

(75) Inventors: Yongzhang Leng, Damascus, MD (US); Brian P. Turner, Damascus, MD (US); James E. Simpson, Gaithersburg, MD (US)

(73) Assignee: Fusion Lighting, Inc., Rockville, MD (US)

( * ) Notice: Subject to any disclaimer, the term of this patent is extended or adjusted under 35 U.S.C. 154(b) by 0 days.

(21) Appl. No.: 09/423,808

(22) PCT Filed: May 20, 1998

(86) PCT No.: PCT/US98/10327

§ 371 (c)(1),
(2), (4) Date: Nov. 12, 1999

(87) PCT Pub. No.: WO98/33474

PCT Pub. Date: Nov. 20, 1998

Related U.S. Application Data

(60) Provisional application No. 60/047,350, filed on May 21, 1997, and provisional application No. 60/047,351, filed on May 21, 1997.

(51) Int. Cl.[7] ..... H01J 17/20; H01J 61/12

(52) U.S. Cl. ..... 313/637; 313/638; 313/571; 313/161; 313/567; 315/248; 315/39

(58) Field of Search ..... 313/637, 638, 313/571, 161, 567; 315/248, 344, 39

(56) References Cited

U.S. PATENT DOCUMENTS

| | | | | |
|---|---|---|---|---|
| 3,860,854 | A | 1/1975 | Hollister | 315/248 |
| 3,979,624 | A | 9/1976 | Liu et al. | 313/229 |
| 5,227,698 | A | 7/1993 | Simpson et al. | 315/248 |
| 5,363,015 | A | 11/1994 | Dakin et al. | 313/638 |
| 5,404,076 | A | 4/1995 | Dolan et al. | 313/572 |
| 5,479,072 | A | 12/1995 | Dakin et al. | 313/638 |
| 5,594,303 | A | 1/1997 | Simpson et al. | 315/39 |
| 5,688,064 | A | 11/1997 | Shanks | 403/24 |

FOREIGN PATENT DOCUMENTS

| | | | |
|---|---|---|---|
| EP | 0 653 778 A | 5/1995 | H01J/65/04 |
| EP | 0 684 629 A | 11/1995 | H01J/65/04 |
| WO | 92/08240 | 5/1992 | |
| WO | 93/21655 | 10/1993 | |
| WO | 94/08439 | 4/1994 | |
| WO | 95/10848 | 4/1995 | |
| WO | 96/28840 | 9/1996 | |
| WO | 96/33509 | 10/1996 | |
| WO | 97/27609 | 7/1997 | |

*Primary Examiner*—Ashok Patel
(74) *Attorney, Agent, or Firm*—Paul E. Steiner

(57) ABSTRACT

An electrodeless lamp includes a stationary bulb (10) containing a fill for producing a discharge, the fill has a primary radiating material which ordinarily produces an unstable discharge in the absence of bulb rotation. The fill further includes an alkali metal in an amount sufficient to stabilize the discharge without bulb rotation. The alkali metal may be, for example, cesium bromide. Preferably, the fill is excited by a non-stationary electric field (E, E1) such as, for example, a circular polarized electric field.

26 Claims, 9 Drawing Sheets

NON-ROTATING ELECTRODELESS LAMP CONTAINING MOLECULAR FILL

CROSS REFERENCE TO RELATED APPLICATIONS

This application is a national phase application of PCT/US98/10327 and claims the benefit of priority of U.S. provisional application Nos. 60/047,350 and 60/047,351, both filed May 21, 1997.

This invention was made with Government Support under Contract No. NAS 10-12114 awarded by the National Aeronautics and Space Administration. The Government has certain rights in this invention.

BACKGROUND OF THE INVENTION

1. Technical Field

The present invention pertains to improvements for envelopes containing a fill for use in electrodeless lamps and has particular, although not limited, utility in lamps of the type disclosed in U.S. Pat. No. 5,404,076 and PCT International Publication No. WO 92/08240, the disclosures of which are expressly incorporated by reference herein in their entirety.

More particularly, the present invention is directed to an improved electrodeless sulfur or selenium lamp which does not require bulb rotation. The present invention further relates to electrodeless discharge lamps for exciting fills in electrodeless lamp bulbs with circular polarized microwave energy.

2. Related Art

Recently, a new lamp providing visible radiation, known as the sulfur lamp, or selenium lamp, depending on which substance is used, has been introduced. This lamp provides a superior spectral output at high efficacy, and enjoys a very long lifetime in, for example, an electrodeless lamp environment.

In these lamps, sulfur, selenium, or both as the case may be, is provided in a lamp bulb in an amount sufficient, when suitably excited, to provide principally molecular radiation in the visible region of the spectrum. The lamp, which typically includes a bulb which is rotated during operation, is described in detail in the above-referenced publications and also in PCT publications WO 95/10848, WO 96/28840, WO 96/33509, and WO 97/27609, and U.S. Pat. Nos. 5,594,303, and 5,688,064, each of which is incorporated herein by reference in its entirety.

PCT Publication No. WO 94/08439 (the '439 Publication) discusses the desirability of rotation at sufficient speeds in order to fill the interior of the bulb with an arc discharge, i.e., to prevent isolated discharges from occurring.

For many applications, it would be desirable to operate the lamp without bulb rotation. For example, the motor required for rotation adds expense to the system and reduces reliability. Since the electrodeless bulb has a very long lifetime, the motor is apt to fail before the bulb, thus requiring maintenance and/or replacement which would otherwise be unnecessary.

OBJECTS AND SUMMARY OF THE INVENTION

In accordance with the present invention it has been discovered that in an excited fill which would otherwise require rotation to stabilize the arc, an alkali metal present in the excited fill stabilizes the arc without bulb rotation. The alkali metal may be introduced in the unexcited fill in the form of a halide, and cesium is the most practical of the alkali metals. Cesium bromide is a compound which may be utilized.

The invention also provides an unexpected advantage in that the cesium has the effect of altering the spectral output of the lamp in a positive way. Thus, it has been found that the color rendering index (CRI) of a lamp including cesium is higher than in its absence, providing a desirable higher red to blue ratio of emitted light.

In the absence of bulb rotation, the fill is preferably excited by a non-stationary electric field in order to spread the discharge out, minimize hot spots, and prolong bulb life. A non-stationary electric field is an electric field having a direction which changes, with respect to a fixed location on the bulb, during lamp operation. For example, the fill is preferably excited by circular polarized microwave energy.

In accordance with one aspect of the invention, circular polarization is provided from a microwave circuit inserted between a source of microwave power and a cylindrical cavity containing an electrodeless lamp. For example, an electrodeless microwave discharge lamp is provided with a waveguide coupling structure for coupling an electromagnetic wave from a single aperture in a rectangular waveguide to a cylindrical waveguide containing an electrodeless lamp bulb. The waveguide coupling structure includes one end having an aperture connected to the single aperture of the rectangular waveguide, and another end which is connected to a cylindrical waveguide. The waveguide coupling structure creates two modes of electromagnetic radiation at the end which connects to the waveguide from the microwave radiation received from the rectangular waveguide. The two modes of electromagnetic radiation have a phase velocity which differs, and at the point of coupling to the cylindrical waveguide are out of phase by 90°. The microwave radiation incident to the waveguide is circularly polarized by virtue of the phase difference between the two modes of electromagnetic radiation, and provides a rotating electric field around a longitudinal axis of the cylindrical waveguide. When an electrodeless lamp is supported along the axis of the cylindrical waveguide, the lamp plasma is more evenly excited, creating a more uniform temperature distribution about the circumference of the lamp envelope.

The waveguide coupling structure may be configured from a rectangular waveguide section, which has first and second sectional dimensions to provide a different phase velocity to first and second orthogonal modes of electromagnetic radiation. The height of the rectangular waveguide is selected so that a substantially 90° phase difference exists between the two modes at the point where it is coupled to the cylindrical waveguide. In yet other embodiments of the invention, a dielectric material may be supported in a plane of a waveguide section, perpendicular to the plane of the rectangular waveguide single aperture which supplies the electromagnetic wave. The dielectric material induces a different phase velocity for first and second modes of coupled microwave electromagnetic radiation.

Other embodiments of the invention employ a microstrip antenna structure which is placed in a cylindrical waveguide structure, connecting the rectangular waveguide single aperture to the cylindrical waveguide having the electrodeless lamp. The microstrip antenna generates a circular polarized electric field which excites an electrodeless lamp.

BRIEF DESCRIPTION OF THE DRAWINGS

The invention will be better understood by reference to the following description and the accompanying drawings, wherein.

DESCRIPTION

Figure 1:
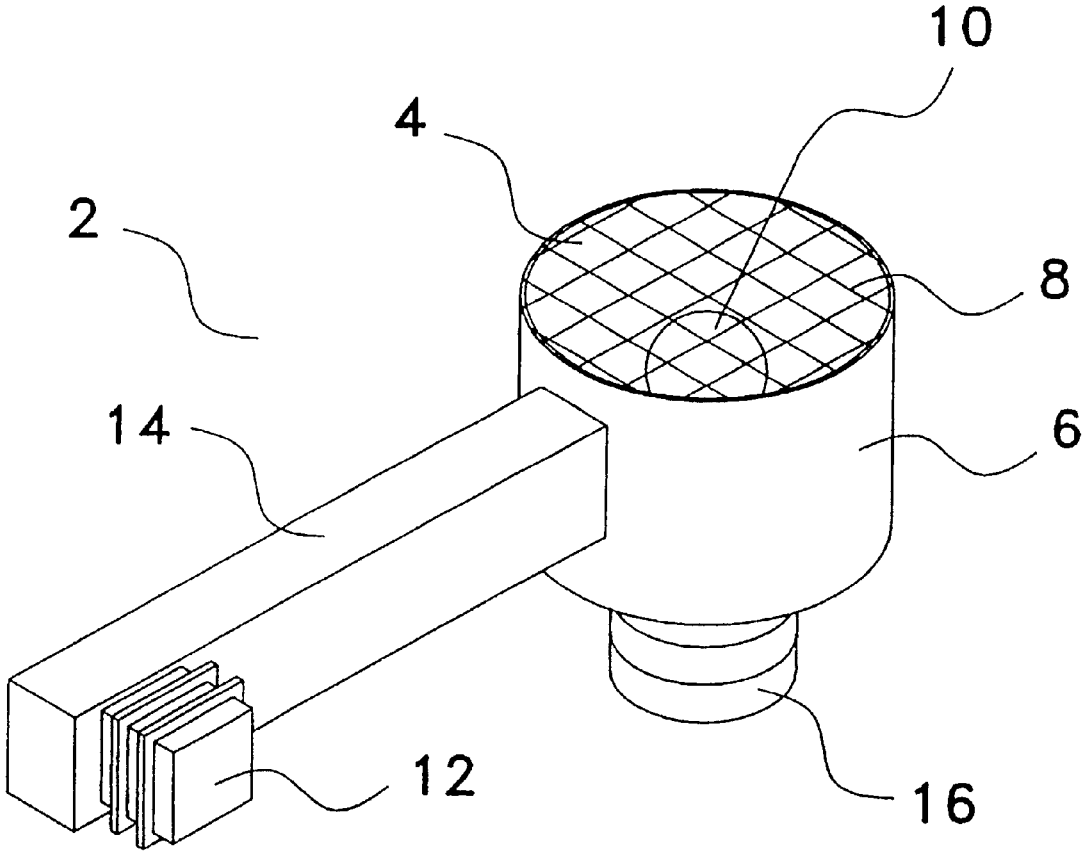
FIG. 1 is a perspective view of a conventional electrodeless lamp which includes a motor for rotating the bulb.

Referring to FIG. 1, an electrodeless lamp 2 is depicted which is powered by microwave energy, it being understood that other sources of high frequency power (e.g. radio frequency (RF) energy) may be used as well. The lamp 2 includes a microwave cavity 4 which is comprised of a cylindrical member 6 and a mesh 8. The mesh 8 is effective to allow the light to escape from the cavity while retaining the microwave energy inside.

A bulb 10 is disposed in the cavity, which includes, for example, a sulfur and/or selenium based fill. Microwave energy is generated by a magnetron 12, and a waveguide 14 transmits such energy to a slot (not shown) in the cavity wall, from where it is coupled to the cavity and particularly to the fill in the bulb 10. It is noted that the lamp includes a motor 16, the shaft of which is attached to the stem of the bulb 10 for rotating the bulb 10.

Figure 2:
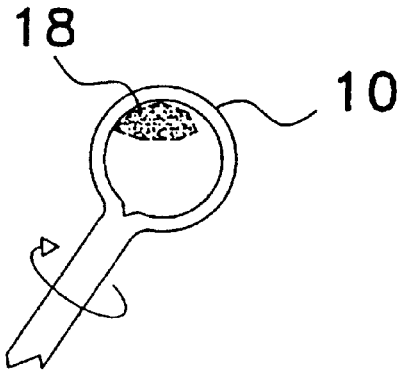
FIG. 2 is an illustration of an isolated discharge which occurs with some fills without sufficient rotation speed.
Figure 3:
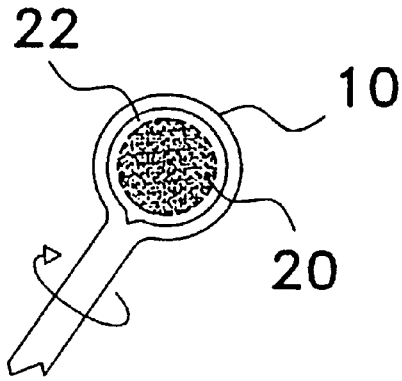
FIG. 3 is an illustration of a fuller discharge which occurs with sufficient rotation speed.

As mentioned above, the '439 Publication discloses aspects of the bulb rotation in detail. FIG. 2 herein corresponds essentially to FIG. 1*a* of the '439 Publication, and illustrates a case where appropriate rotation is not accomplished. As shown in FIG. 2, an isolated or spatially incomplete discharge 18 results in bulb 10 which is not stable. On the other hand, FIG. 3 herein corresponds essentially to FIG. 1*b* of the '439 Publication, and depicts a discharge 20 which results with sufficient rotation. As shown in FIG. 3, the discharge 20 substantially fills the interior of the bulb 10, except for a thin boundary layer 22 between the discharge 20 and the bulb wall (shown larger than actual size in the drawing).

As discussed above, it would be desirable to obviate the need for rotation since a motor adds expense to the system and is apt to fail before the bulb, thus requiring additional maintenance and/or replacement.

In accordance with the present invention it has been found that the presence of an alkali metal in the excited bulb fill enlarges and stabilizes an otherwise unstable discharge, thus obviating the need for rotation. Thus, a lamp can be provided which does not have a motor, which is a tremendous advantage. PCT Publication No. WO 93/21655 (the '655 Publication), incorporated herein by reference in its entirety, discloses the addition of alkali halides to a sulfur or selenium lamp for improving starting, rendering spatially uniform spectral output around the bulb, and allowing lower power operation without extinguishing. It is also well known that cesium may be added to an already stable discharge to make the discharge more diffuse. U.S. Pat. No. 3,979,624 discloses an electroded arc discharge lamp wherein cesium is added to an otherwise stable discharge in order to broaden the arc. U.S. Pat. No. 5,479,072 discloses an electrodeless arc discharge lamp wherein cesium is added to an otherwise stable discharge in order to fatten the arc. However, these references do not disclose that such an alkali metal fill additive would stabilize a discharge which would otherwise be unstable without rotation.

An additional unexpected advantage is provided in that it has been found that the presence of an alkali metal such as cesium modifies the spectrum and provides improved color rendering.

By way of explanation, sulfur and selenium plasmas are electronegative, with sulfur being more so than selenium. According to the invention, alkali metals, which have low ionization potentials, are used to provide extra electrons which result in stabilization of the arc. A very small amount of alkali metal doping, including amounts less than one-tenth milligram per cubic centimeter (0.1 mg/cc) and preferably less than one-hundredth milligram per cubic centimeter (0.01 mg/cc) can provide sufficient electron densities.

Cesium is the preferred alkali metal because it has a relatively low ionization potential and does not leak through the quartz wall. Other alkali metals (e.g. sodium, potassium) may also be used, although problems with leakage may occur.

Figure 4:
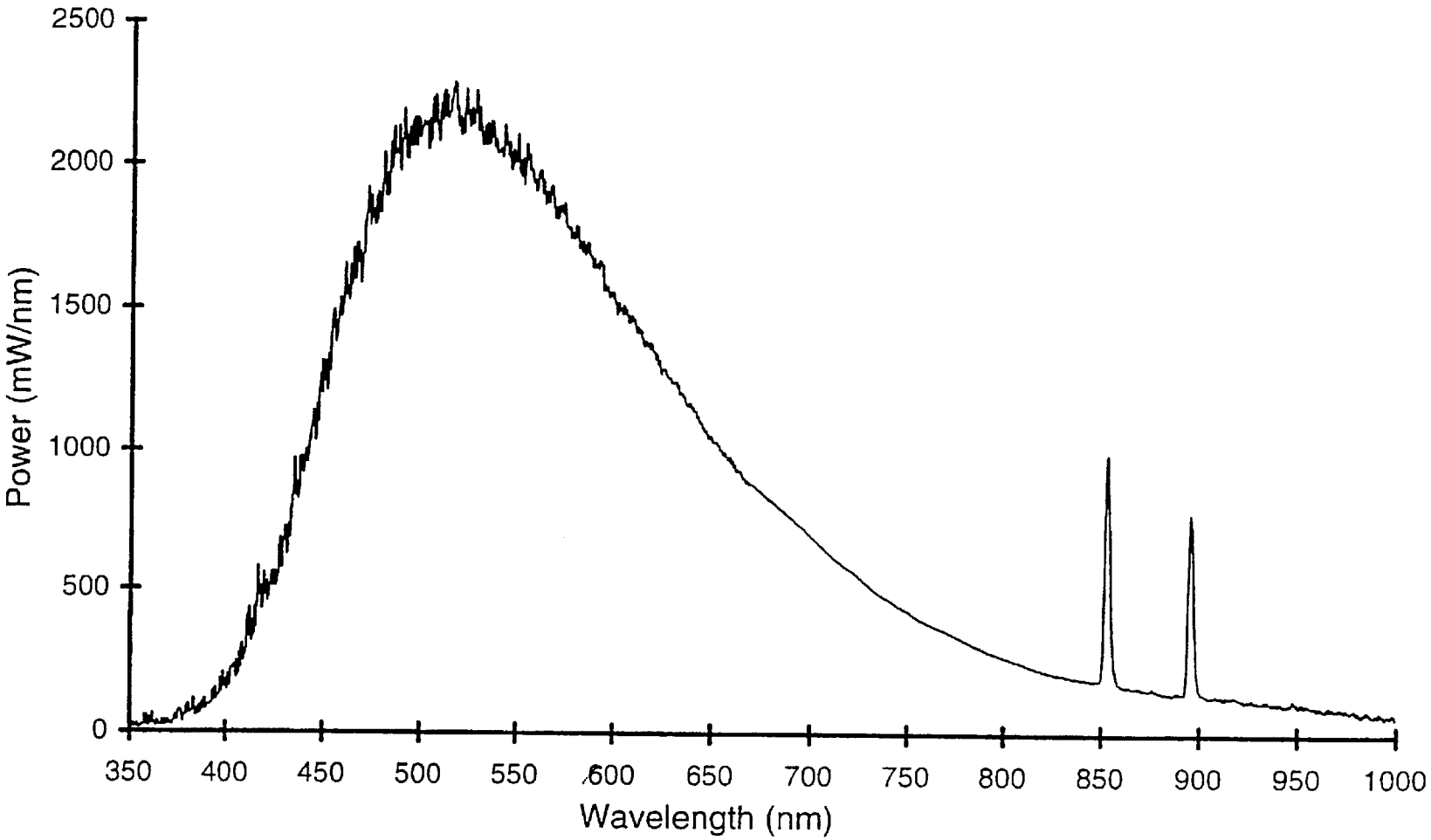
FIG. 4 is a graphical representation of a spectrum of a cesium bromide doped sulfur fill in a non-rotating electrodeless lamp.

FIG. 4 is a graphical representation of a spectrum of a cesium bromide doped sulfur fill in a non-rotating electrodeless lamp. It is seen that cesium adds line radiation in the infrared. In accordance with the invention, the amount of cesium added is very small, preferably just enough to stabilize the arc. Larger amounts of cesium increase the amount of infrared radiation and thereby decrease the lamp efficiency. Preferably, cesium is added in an amount such that the atomic lines from cesium have less power than the peak power of the molecular radiation from the primary fill substance. In determining the appropriate amount of cesium doping, consideration must also be given the loss of cesium that occurs during initial lamp operation because some cesium may react with the quartz wall and thereafter will be unavailable for stabilizing the arc. The appropriate amount of cesium doping may be readily determined through routine experimentation.

Figure 5:
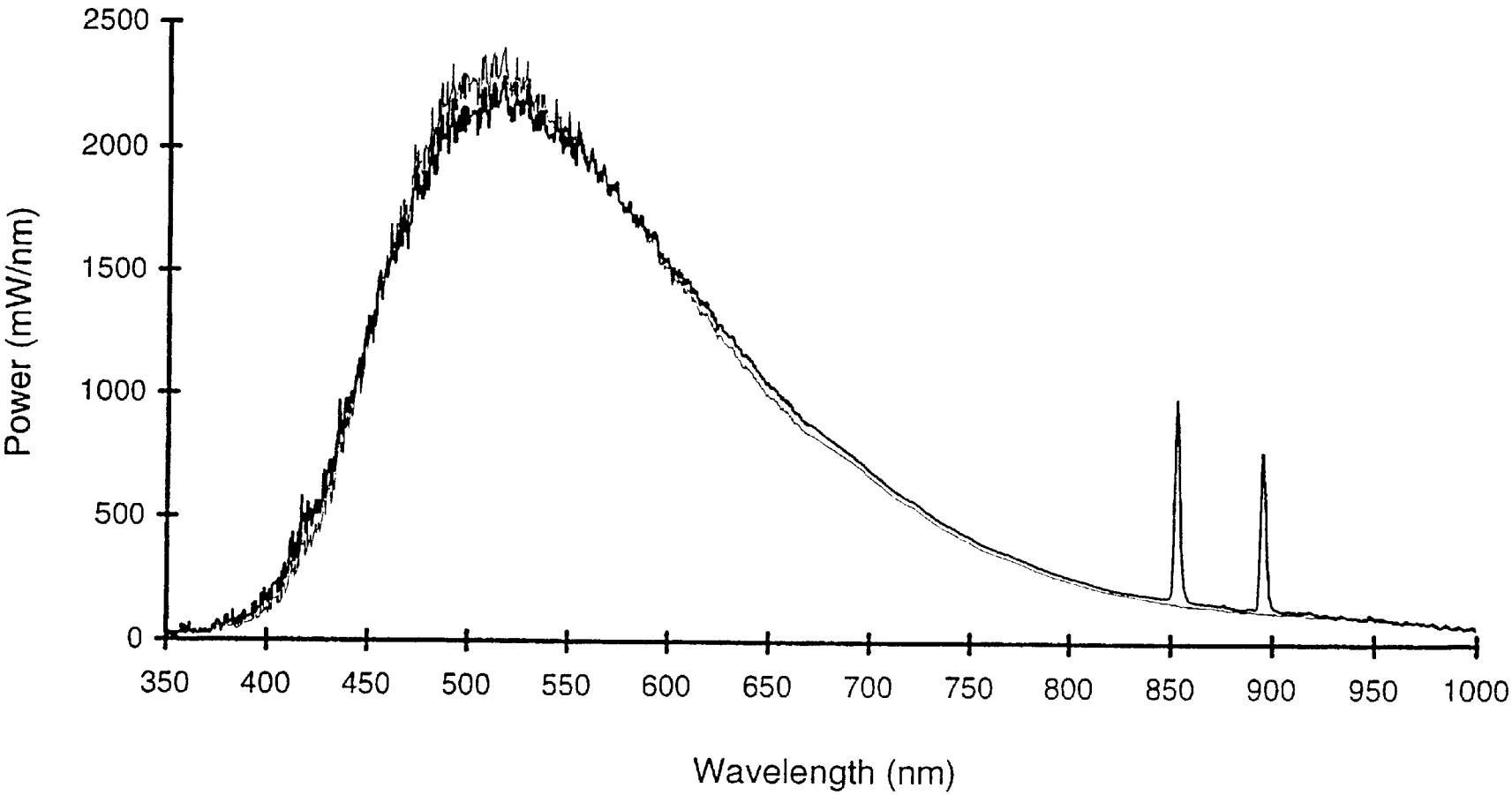
FIG. 5 is a comparison of spectra of a sulfur fill in a rotating electrodeless lamp and the cesium bromide doped sulfur fill in a non-rotating electrodeless lamp.

FIG. 5 is a comparison of the spectra of a standard Solar 1000™ P3 SAA lamp, made by Fusion Lighting, Inc., Rockville, Md., USA, exciting a pure sulfur fill while utilizing bulb rotation (thin line) versus the same lamp platform exciting a cesium doped sulfur fill without bulb rotation (thick line). For ease of comparison the spectra were normalized to the total radiated power (same area under the curve).

The sulfur-only spectrum has a correlated color temperature (CCT) of 5966 K and a color rendering index (CRI) of 79.45. The cesium doped sulfur spectrum has a CCT of 5821 K and a CRI of 81.52. Hence, the color rendering index of the cesium doped bulb is superior to that of the bulb without cesium. There is a further unexpected effect in that the CRI usually decreases with decreasing CCT, so those skilled in the art would expect a lower CRI with a cesium doped bulb rather than a higher one. The increased color rendering index corresponds to a higher red to blue ratio which improves the quality of the light which is provided.

Although the foregoing example is provided with respect to a microwave discharge lamp, those skilled in the art will appreciate that the invention may be utilized in other lamps, such as those described in the '655 Publication. By way of non-limiting example, inductively coupled and capacitively coupled lamps may also be used. Moreover, although the foregoing example is provided with respect to a sulfur-based fill, those skilled in the art will appreciate that the invention applies to other molecular fills which tend to be unstable unless excited in a rotating bulb. By way of non-limiting example, similar stabilization would result for either a selenium or tellurium fill. Other fills which radiate very efficiently (i.e. the discharge tends to collapse on itself) may also be stabilized by the addition of a small amount of alkali metal.

In the standard Light Drive™ 1000 configuration, the electric field is linear across the bulb and stationary. In this configuration without rotation, localized hot spots may develop where the field intersects the bulb wall and forced air cooling may be used in order to extend bulb life. In accordance with a preferred embodiment of the invention, an alkali metal doped fill is excited with a non-stationary electric field so that ambient cooling (e.g. room temperature) alone is sufficient to maintain long bulb life. For example, U.S. Pat. No. 5,227,698 (the '698 Patent) discloses various electrodeless lamp configurations which produce a rotating electric field. Other lamp structures are also known to produce a non-stationary electric field.

The '698 patent describes various electrodeless lamps which produce an electric field which rotates around the axis of the bulb, thereby tending to change the position in which the electric field is normal to the envelope wall. The rotation of the electric field results from using a circular polarized microwave field which rotates about an axis of the bulb at the radio frequency rate of the microwave field. The principle technique set forth in the '698 patent for providing circular rotation utilizes a single microwave signal source split into two output signals having a 90° phase difference which are coupled to two separate ports on a cylindrical waveguide containing the electrodeless lamp bulb. In accordance with an aspect of the present invention, alternate structures are provided for exciting a fill in an electrodeless lamp bulb with a circular polarized field.

Figures 6, 7:
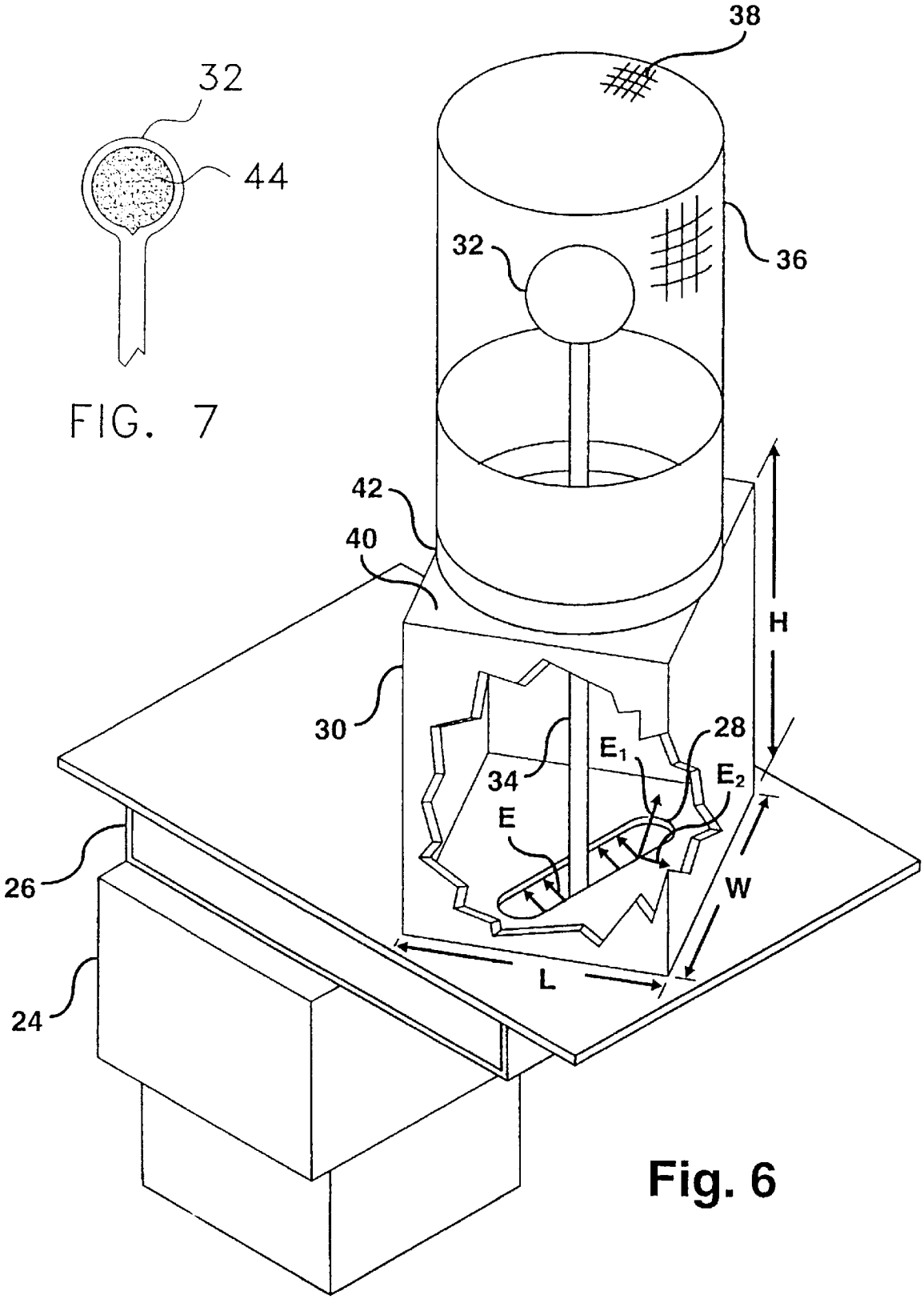
FIG. 6 illustrates a first embodiment of an electrodeless lamp according to the invention which uses a rectangular waveguide coupling structure to generate a circular polarized electric field.
FIG. 7 is an illustration of a discharge of a cesium bromide doped sulfur fill excited in the lamp illustrated in FIG. 6.

FIG. 6 illustrates a first embodiment of an electrodeless lamp according to the invention which uses a rectangular waveguide coupling structure to generate a circular polarized electromagnetic field. In the embodiment of FIG. 6, a circularly polarized microwave field is generated which rotates about an axis of the bulb at the radio frequency rate of the microwave field. In combination with a cesium doped sulfur fill, this structure minimizes hot spots and causes the discharge to further fill out the interior of the envelope.

Referring to FIG. 6, a source of microwave energy comprising a magnetron 24 is coupled to a rectangular waveguide section 26. The upper surface of the rectangular waveguide section 26 includes a longitudinal slot 28 which couples the microwave energy from the waveguide 26 into a coupling device 30.

An electrodeless lamp bulb 32 is supported on a stationary support 34, which passes through the slot 28 and is mounted, for example, to the waveguide 26. A cylindrical waveguide section 36 having a perforated exterior surface or mesh for emitting light from the bulb 32 is coupled to the coupling device 30. A similarly perforated or mesh top section 38 is provided at the end of the cylindrical waveguide section 36 to form a resonant microwave cavity. The cylindrical waveguide section 36 receives microwave energy through a similarly sized (e.g. same diameter) circular hole within the top surface 40 of the coupling device 30. A clamp 42 attaches the cylindrical waveguide 36 to a flange (not shown) which is integral with the top surface 40 of the coupling device 30 and holds the cylindrical waveguide 36 in place.

As is known in conventional microwave applications, an electric field E across the slot 28 is substantially perpendicular to the longer dimension of the slot 28. Associated with the electric field E are two orthogonal components, $E_1$ and $E_2$. The orthogonal components $E_1$, $E_2$ constitute first and second modes of propagation within the coupling device 30. The rectangular geometry of coupling device 30 propagates each of the modes represented by the perpendicular components of the field, $E_1$ and $E_2$. The wavelengths $\lambda_{g1}$ and $\lambda_{g2}$ of the radiation of each of these modes can be represented in terms of a free space wavelength $\lambda_o$, and the dimension L or W for each of components $E_1$, $E_2$ as follows:

$$\lambda_{g1} = \frac{\lambda_0}{\sqrt{1-\left(\frac{\lambda_0}{2L}\right)^2}} \quad \text{Equation (1)}$$

$$\lambda_{g2} = \frac{\lambda_0}{\sqrt{1-\left(\frac{\lambda_0}{2W}\right)^2}} \quad \text{Equation (2)}$$

where in accordance with the above equations $\lambda_o$ is the free space wavelength for the electromagnetic energy, having a frequency of $f_o$, and L and W represents the cross-sectional dimensions for the coupling device 30.

To obtain a circularly polarized waveform at the top surface 40 having the circular hole therein, the phase relationship between the two modes of electromagnetic energy propagating along the axis of the cylindrical waveguide 36 will be different as $\lambda_{g1}$ and $\lambda_{g2}$ representing the wavelength of each mode is different. By selecting an appropriate height H for the coupling device 30, the phase of the two propagating modes of electromagnetic radiation may be placed at 90° with respect to each other at the point where it couples to the cylindrical waveguide 36.

The 90° phase relationship between the two modes of electromagnetic energy at the top surface 40 of the coupling device 30 will result in a circular polarized electromagnetic wave propagating along the axis of the cylindrical cavity 36. The correlation between the height and the phase representing a difference of ¼ of a wavelength producing the 90° phase relationship can be represented as follows:

$$\frac{H}{\lambda_{g1}} - \frac{H}{\lambda_{g2}} = \frac{1}{4} \qquad \text{Equation (3)}$$

Thus, with the embodiment in accordance with FIG. 6, the bulb 32 remains stationary while the microwave exciting field rotates about the axis of the cylindrical waveguide 36, resulting in a more uniform temperature distribution about the surface of the bulb.

Figure 8:
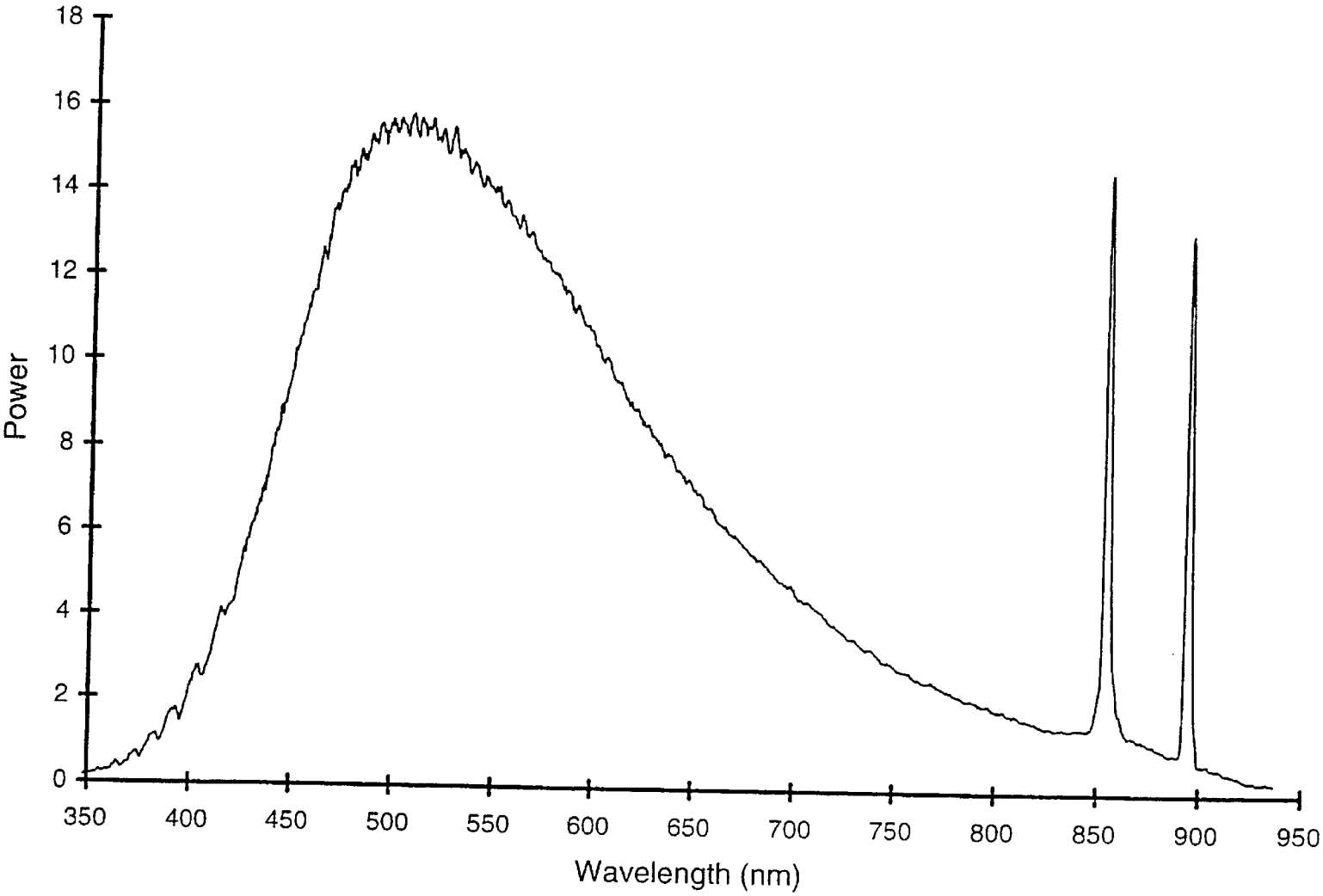
FIG. 8 is a graphical representation of a spectrum of the cesium bromide doped sulfur fill in the lamp illustrated in FIG. 6.

An exemplary electrodeless lamp built in accordance with the embodiment of FIG. 6 includes a bulb having an outer diameter of 25 mm and an inner diameter of about 23 mm (about 6.4 cc) and filled with 11 mg of sulfur (about 1.7 mg/cc), 50 Torr of argon, and 0.06 mg of cesium bromide (about 0.0094 mg/cc). The bulb is supplied with about 350 watts of microwave power. FIG. 7 is an illustration of a discharge of the cesium bromide doped sulfur fill excited in the lamp illustrated in FIG. 6. As shown in FIG. 7, a discharge 44 substantially fills the interior of the bulb 32. The discharge 44 is stable and the lamp has been operating for over 9000 hours with the bulb 32 in a vertical orientation. FIG. 8 is a graphical representation of a spectrum of the cesium bromide doped sulfur fill in the lamp illustrated in FIG. 6 after over 9000 hours of operation.

Figure 9:
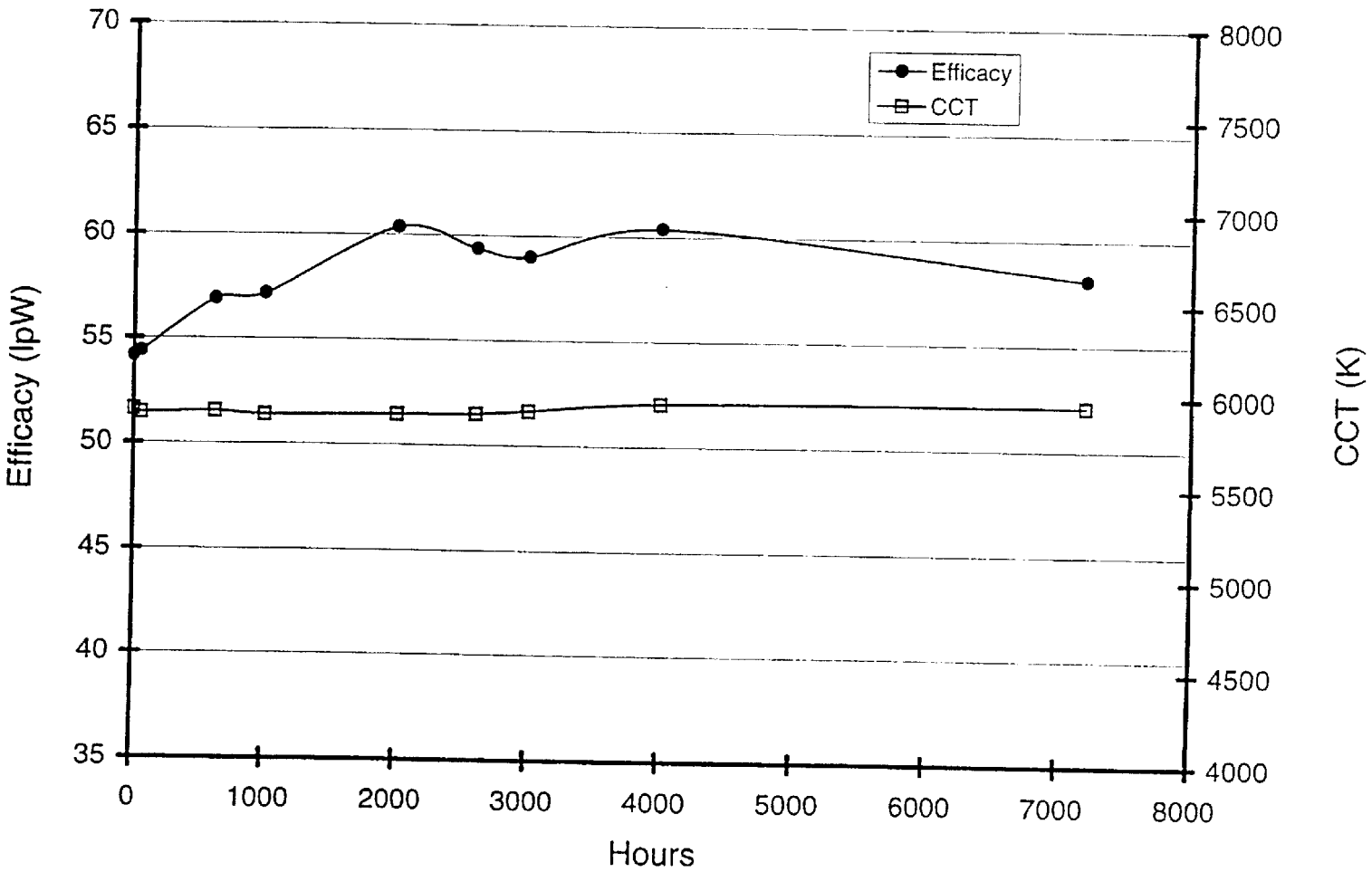
FIG. 9 is a graph of life test data for both efficacy and correlated color temperature for the lamp illustrated in FIG. 6.

FIG. 9 is a graph of life test data for both efficacy and correlated color temperature. As can be seen from FIG. 9, the efficiency of the lamp improves during initial operation as the cesium combines with the quartz wall, thereby reducing the amount of infrared radiation. After saturation is reached, the lamp efficiency stabilizes. The CCT and the CRI (about 81) of the lamp remained essentially constant for over 9000 hours of operation.

Figure 11:
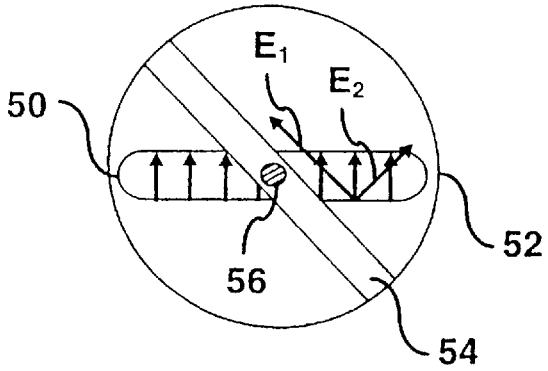
FIG. 11 is a section view of the embodiment of FIG. 10 illustrating the orientation of the dielectric plate with respect to the coupling slot.
Figure 10:
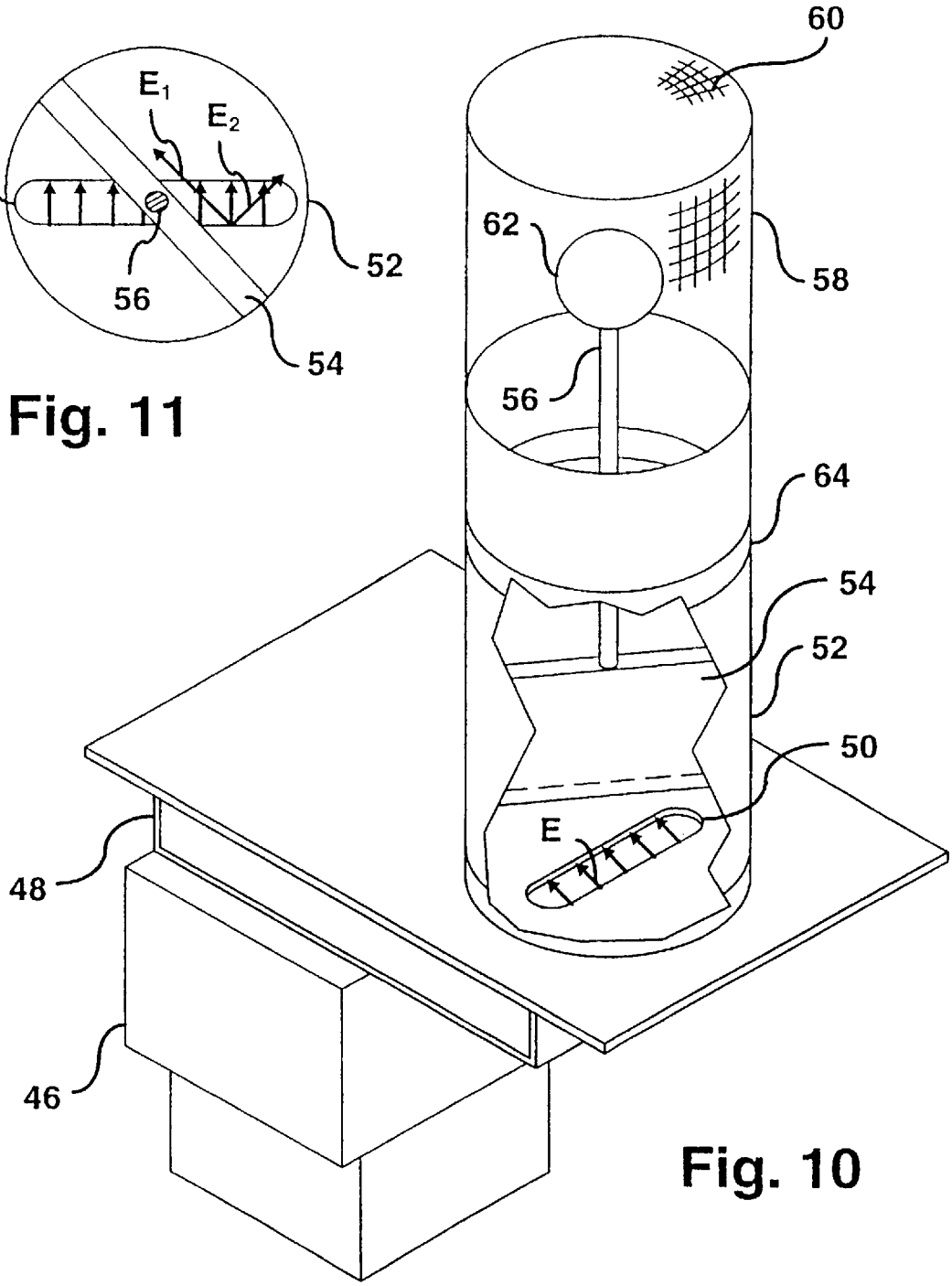
FIG. 10 illustrates a second embodiment of an electrodeless lamp according to the invention which uses a dielectric plate for establishing two modes of electromagnetic radiation having a different phase velocity.

FIGS. 10 and 11 illustrate a second embodiment of the invention which generates a circular polarized electric field for exciting a fill in an electrodeless lamp. FIG. 10 illustrates an electrodeless lamp according to the invention which uses a dielectric plate for establishing two modes of electromagnetic radiation having a different phase velocity. FIG. 11 is a section view of the embodiment of FIG. 10 illustrating the orientation of the dielectric plate with respect to the coupling slot.

In the embodiment of FIGS. 10 and 11 a magnetron 46 is coupled to a rectangular waveguide 48. The rectangular waveguide 48 includes along a top surface thereof a coupling slot 50 for coupling electromagnetic radiation to a generally cylindrical waveguide 52. Disposed within the cylindrical waveguide 52, at a distance above the slot 50, is a dielectric material 54 which is oriented with respect to the slot as shown in FIG. 11. A lamp support 56 is in turn supported on the dielectric 54. The dielectric 54 in turn is supported on the side walls of the cylindrical waveguide 52 perpendicular to the plane of the slot 50. A portion 58 of the cylindrical waveguide 52 is perforated and closed along the top 60 with, for example, perforated screening to form a resonant microwave cavity. Light radiated by a bulb 62 is radiated outwardly from the portion 58 of the cavity. The portion 58 is connected with the remainder of the cylindrical waveguide 52, for example, by a clamp 64.

Orthogonal components $E_1$, $E_2$ of the electric field E produced from the slot 22 have a phase velocity which differ with respect to each other due to the presence of the dielectric 54. The dielectric material 54, supported perpendicularly to the plane of slot 22, delays the phase of $E_1$ with respect to $E_2$, such that a 90° phase shift is introduced in the juncture of the portion 58 and the lower portion of the cylindrical waveguide 52. The rotating field produced as a result of the phase shift rotates about the axis of support 56, which also corresponds to the axis of the bulb 62 and the axis of the resonant cavity.

Figure 12:
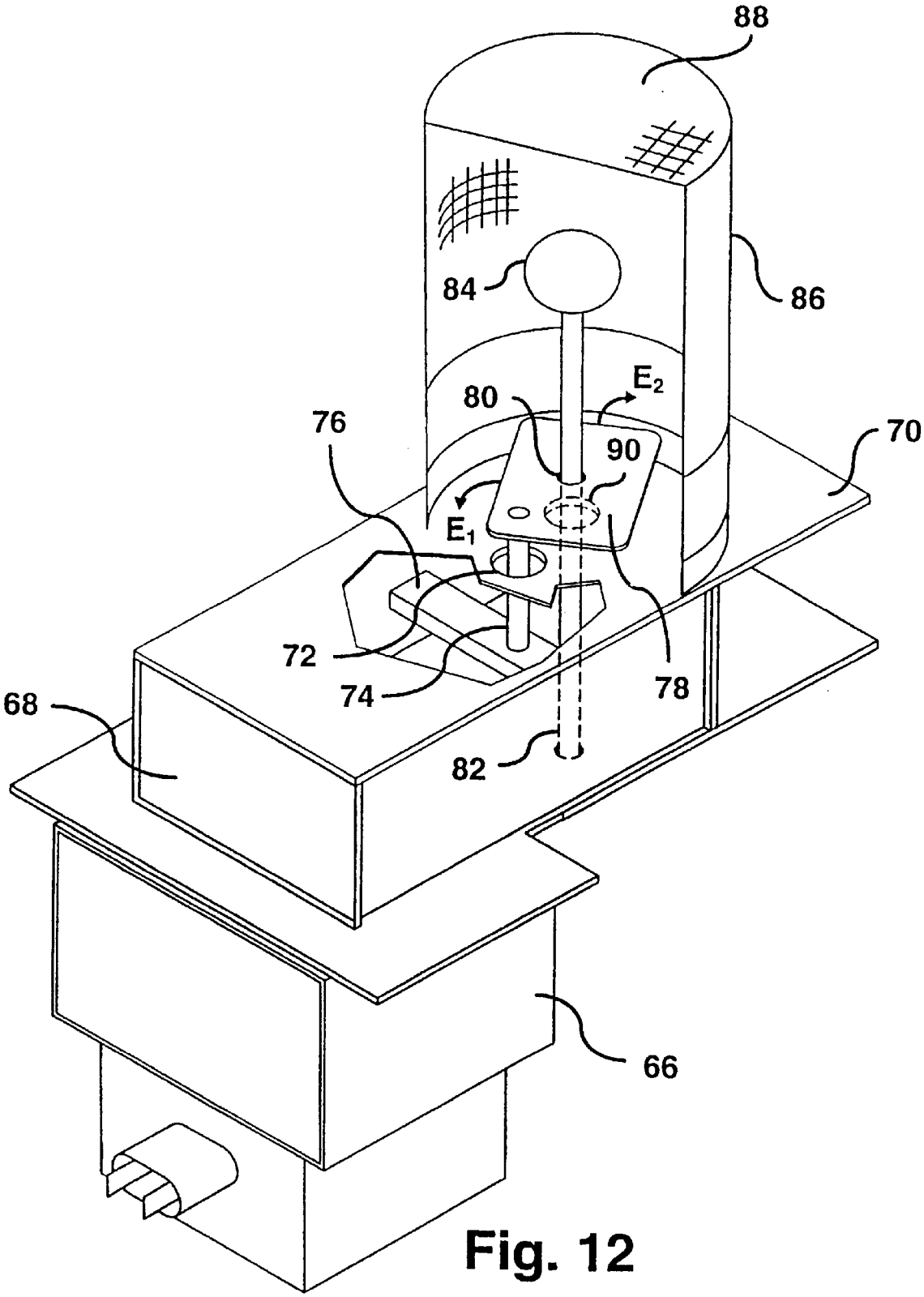
FIG. 12 illustrates another embodiment of the invention having an air dielectric microcircuit antenna to create a circular polarized electric field.

Referring now to FIG. 12, there is shown yet another embodiment of the invention which produces a circularly polarized electric field for exciting a fill in an electrodeless lamp. In FIG. 12, the electrodeless lamp includes an air dielectric microcircuit antenna to create a circular polarized electric field. A magnetron 66 is coupled to a rectangular waveguide section 68. The rectangular waveguide section 68 includes along a top surface 70 thereof a first opening 72. Supported within the opening 72 is a feed conductor 74 which is supported by a support block 76 mounted within the rectangular waveguide 68. The conductor 74 couples the microwave electromagnetic energy to an air dielectric antenna 78 comprising a substantially rectangular plate with rounded comers. A hole 80 within rectangular plate 78 provides a clearance hole for a bulb support 82. The support 82 and an axis of a bulb 84 are coincident with the axis of a cylindrical waveguide 86, which includes a perforated screen surface for emitting light produced from the bulb 84 and is closed by a mesh top 88 to form a resonant microwave cavity. The support 82 passes through a second opening 90 and is secured within the waveguide 68.

The air dielectric antenna 78 and the feed conductor 74 produce along the edges thereof, fringe fields $E_1$ and $E_2$. The fringe fields produce first and second orthogonal modes of radiation, which combine to produce a circular polarized electric field along the axis of the cylindrical waveguide 86. The current in the feed conductor 74 provides a surface current in the underside of the air dielectric antenna 78 along both the long and narrow dimensions which have different resonant frequencies. The dimensions of the air dielectric antenna 78 are selected to place the long dimension resonance below 2450 MHz, when augmented by the fringing capacitive fields at the ends, while a narrow dimension resonance is placed above 2450 MHz. Driving the resonators, represented by the long and narrow dimensions of the plate, at an off resonance frequency produces a phase shift of the wave which results from $E_1$ and $E_2$ on the long and narrow dimensions of the air dielectric antenna 78. If the exciting microwave energy frequency from the magnetron is at 2450 MHz, each of the long and narrow width edges of the plate act as a resonator. Driving the resonator at an off frequency produces a phase shift, and when the phase shift difference is one half the resonant bandwidth, a 45° phase difference is obtained for each resonator for net phase difference of 90°, thus producing the two orthogonal components which combine to form the circular polarized signal for exciting the fill in the bulb 84.

It should, of course, be recognized that the natural resonances provided by the long and narrow dimensions of the air dielectric antenna 78 are modified because of loading presented by the electrodeless bulb. The resonant dimensions for the antenna 78 therefore differ somewhat from an open field radiator with no loading.

Figure 13:
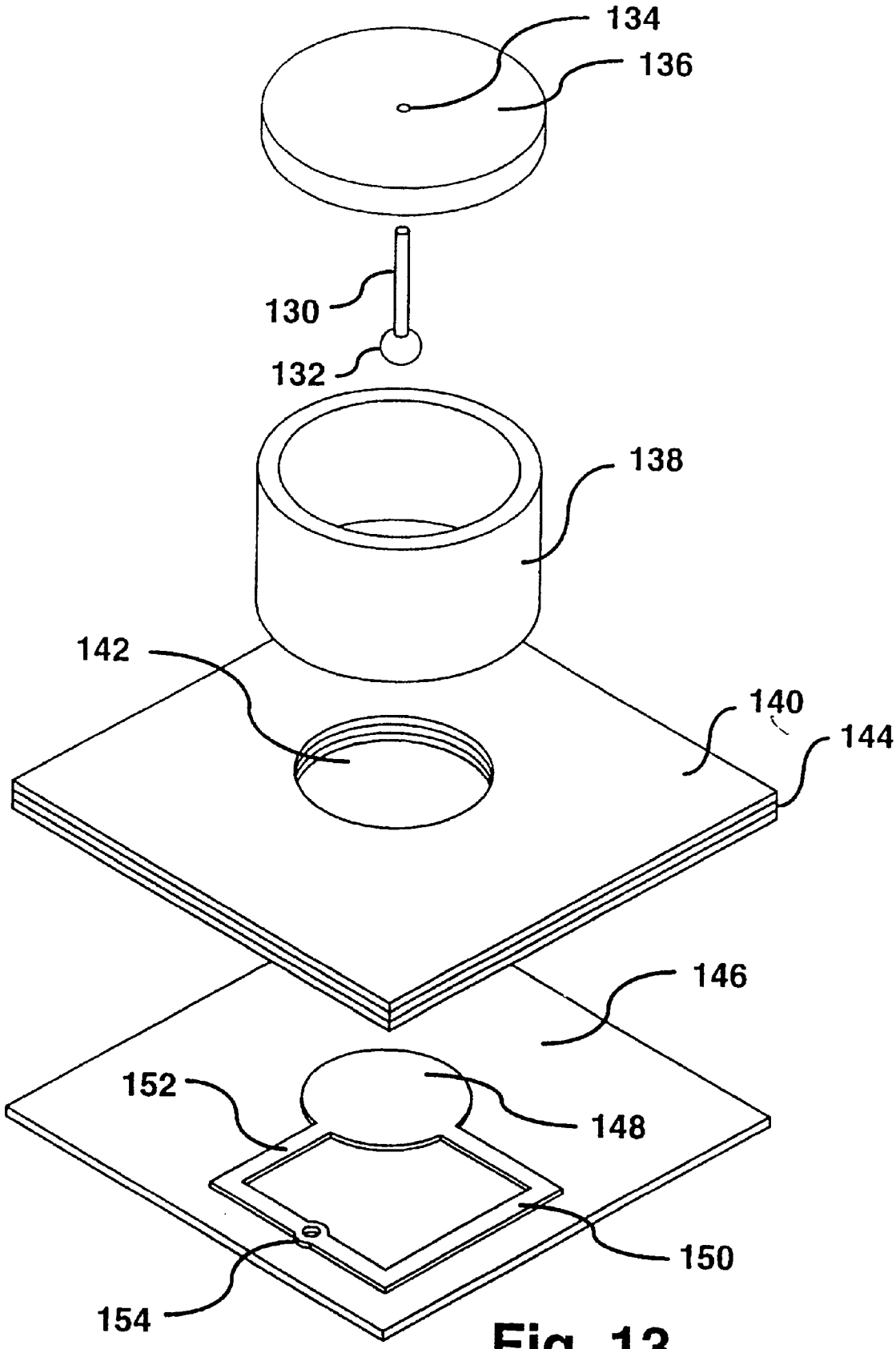
FIG. 13 illustrates another embodiment of the invention wherein a stripline microcircuit provides a circular polarized wave for a cylindrical waveguide section supporting an electrodeless lamp bulb.

FIG. 13 illustrates yet another embodiment for generating a circular polarized electric field for exciting a fill in an electrodeless lamp. In FIG. 13, a stripline microcircuit provides a circular polarized wave for a cylindrical waveguide section supporting an electrodeless lamp bulb. In this embodiment a support 130 comprises a light pipe (which may be straight or tapered) connected at one end to an electrodeless lamp bulb 132. Light from the bulb 132 is emitted through the light pipe 130, which extends through an opening 134 in an end 136 of a waveguide 138. The cylindrical waveguide 138 is supported on a ground plane 140, having an opening 142 therethrough. The ground plane 140 is part of a stripline package including a dielectric 144 and printed microwave circuit 146. The printed microwave circuit 146 includes a generally circular disk 148 which is concentric with the opening 142 in the ground plane 140 and dielectric 144. The disk 148 is fed with two conductors 150 and 152, spaced about the periphery of disk 148 at an angular distance of 90° from each other. The conductors 150 and 152 are connected together at a feed point 154, where electromagnetic radiation is provided to the printed microwave circuit 146.

A connection is made through the printed microwave circuit board 146, from the bottom thereof, to the feed point 154 and to the ground plane 140. The two conductors 150 and 152 have a difference in length corresponding to approximately a quarter of a wavelength, thereby producing first and second phase shifted signals at the respective ends connected to the circular disk 148. The circular disk 148 constitutes a circular resonator feed at perpendicular locations which launches a circularly polarized electromagnetic wave. The wave is coupled to the cylindrical waveguide 138, which encloses the bulb 132. The use of the dielectric circuits reduces the power handling capacity of the lamp and is thus better suited for low power electrodeless lamps. The cavity of the cylindrical waveguide 138 may be filled with a reflecting dielectric material, so that most of the light will be delivered through the light pipe 130.

A long-life electrodeless lamp has been described which affords a stable output and high quality light without the requirement of a motor or of bulb rotation. There has been described with respect to several embodiments a device for producing a circular polarized electric field for exciting a fill in an electrodeless lamp bulb. It should be understood that while the invention has been described in connection with illustrative embodiments, variations will occur to those skilled in the art and the scope of the invention is to be limited only by the claims which are appended hereto and equivalents.

What is claimed is:

1. An electrodeless lamp, comprising:

a stationary bulb containing a fill for producing a discharge, the fill including a primary radiating material which would produce an unstable discharge in the absence of bulb rotation;

a source of high frequency power; and a coupling structure for coupling the high frequency power to the fill, wherein the fill further includes an alkali metal in an amount sufficient to stabilize the discharge without bulb rotation.

2. The lamp as recited in claim 1, wherein the alkali metal comprises cesium.

3. The lamp as recited in claim 2, wherein the fill in an unexcited state includes a cesium halide.

4. The lamp as recited in claim 3, wherein the cesium halide comprises cesium bromide.

5. The lamp as recited in claim 1, wherein the primary radiating material comprises one of sulfur, selenium, and tellurium and wherein the alkali metal comprises cesium.

6. The lamp as recited in claim 5, wherein the fill in an unexcited state includes a cesium halide.

7. The lamp as recited in claim 6, wherein the cesium halide comprises cesium bromide.

8. The lamp as recited in claim 2, wherein the amount of alkali metal provides resonant atomic lines of radiation in the infrared region having less peak power than a peak power of radiation from the primary radiating material.

9. The lamp as recited in claim 8, wherein the amount of alkali metal is less than one-tenth milligram per cubic centimeter.

10. The lamp as recited in claim 8, wherein the amount of alkali metal is less than one-hundredth milligram per cubic centimeter.

11. The lamp as recited in claim 1, wherein the coupling structure provides a non-stationary electric field.

12. The lamp as recited in claim 11, wherein the non-stationary electric field comprises a circular polarized electric field.

13. The lamp as recited in claim 12, wherein the coupling structure comprises:

a first waveguide connected to the source of high frequency power;

a resonant cavity containing the bulb; and a second waveguide connected between the first waveguide and the resonant cavity, the second waveguide having a rectangular cross-section and a height configured to provide the circular polarized electric field in the resonant cavity.

14. The lamp as recited in claim 13, wherein the second waveguide is configured to provide two modes of propagation of the high frequency power which are substantially ninety degrees out of phase with respect to each other at a point where the second waveguide is coupled to the resonant cavity.

15. The lamp as recited in claim 14, wherein the rectangular cross-section of the second waveguide comprises a width and a length configured to provide a different phase velocity to first and second orthogonal modes of electromagnetic radiation, respectively, and wherein the height of the second waveguide is configured to provide the substantially ninety degrees phase difference between the two modes at the point where the second waveguide couples to the resonant cavity.

16. The lamp as recited in claim 12, wherein the coupling structure comprises:

a waveguide connected to the source of high frequency power, the waveguide including a coupling slot;

a resonant cavity containing the bulb; and a dielectric material supported in the resonant cavity perpendicular to a plane of the coupling slot, wherein the dielectric material is configured to provide a different phase velocity to first and second orthogonal modes of electromagnetic radiation, respectively, such that the substantially ninety degrees phase difference between the two modes produces the circular polarized electric field in the resonant cavity.

17. The lamp as recited in claim 12, wherein the coupling structure comprises:

a waveguide connected to the source of high frequency power;

a resonant cavity containing the bulb;

an air dielectric antenna disposed in the resonant cavity; and a feed conductor configured to couple the high frequency power from the waveguide to the air dielectric antenna, wherein the air dielectric antenna produces at respective edges thereof fringe electric fields having first and second orthogonal modes of radiation which combine to produce the circular polarized electric field in the resonant cavity.

18. The lamp as recited in claim 12, wherein the coupling structure comprises:

a resonant cavity containing the bulb;

a stripline antenna circuit configured to receive high frequency power and to provide a circular polarized field to the resonant cavity.

19. The lamp as recited in claim 18, wherein the stripline antenna circuit comprises:

a generally circular disk;

a first conductor connected at one end to a first location on a periphery of the disk; and a second conductor connected at one end to a second location of the periphery of the disk and connected at an other end to an other end of the first conductor, wherein the first location and the second location are spaced at an angular distance of ninety degrees with respect to each other, and wherein the high frequency power is provided to the stripline antenna circuit at the connection point of the respective other ends of the first and second conductors.

20. An electrodeless lamp, comprising:

a bulb containing a fill for producing a discharge;

a source of microwave power;

a first waveguide connected to the source of microwave power;

a resonant cavity containing the bulb; and a second waveguide connected between the first waveguide and the resonant cavity, the second waveguide having a rectangular cross-section and a height configured to provide a non-stationary electric field in the resonant cavity.

21. The lamp as recited in claim 20, wherein the non-stationary electric field is a circular polarized field and wherein the second waveguide is configured to provide two modes of propagation of the microwave power which are substantially ninety degrees out of phase with respect to each other at a point where the second waveguide is coupled to the resonant cavity.

22. The lamp as recited in claim 21, wherein the rectangular cross-section of the second waveguide comprises a width and a length configured to provide a different phase velocity to first and second orthogonal modes of electromagnetic radiation, respectively, and wherein the height of the second waveguide is configured to provide the substantially ninety degrees phase difference between the two modes at the point where the second waveguide couples to the resonant cavity.

23. An electrodeless lamp, comprising:

a bulb containing a fill for producing a discharge;

a source of microwave power;

a waveguide connected to the source of microwave power, the waveguide including a coupling slot;

a resonant cavity containing the bulb and connected to the waveguide for receiving microwave power from the coupling slot; and a dielectric material supported in the resonant cavity perpendicular to a plane of the coupling slot, wherein the dielectric material is configured to provide a different phase velocity to first and second orthogonal modes of electromagnetic radiation, respectively, such that the substantially ninety degrees phase difference between the two modes produces a rotating electric field in the resonant cavity.

24. An electrodeless lamp, comprising:

a bulb containing a fill for producing a discharge;

a source of microwave power;

a waveguide connected to the source of microwave power;

a resonant cavity containing the bulb;

an air dielectric antenna disposed in the resonant cavity; and a feed conductor configured to couple the microwave power from the waveguide to the air dielectric antenna, and wherein the air dielectric antenna produces at respective edges thereof fringe electric fields having first and second orthogonal modes of radiation which combine to produce a circular polarized electric field in the resonant cavity.

25. An electrodeless lamp, comprising:

a bulb containing a fill for producing a discharge;

a source of high frequency power;

a resonant cavity containing the bulb;

a stripline antenna circuit configured to receive high frequency power and to provide a circular polarized field to the resonant cavity.

26. The lamp as recited in claim 25, wherein the stripline antenna circuit comprises:

a generally circular disk;

a first conductor connected at one end to a first location on a periphery of the disk; and a second conductor connected at one end to a second location of the periphery of the disk and connected at an other end to an other end of the first conductor, wherein the first location and the second location are spaced at an angular distance of ninety degrees with respect to each other, and wherein the high frequency power is provided to the stripline antenna circuit at the connection point of the respective other ends of the first and second conductors.

* * * * *